US006099174A

United States Patent [19]

Feumi Jantou et al.

[11] Patent Number: 6,099,174

[45] Date of Patent: Aug. 8, 2000

[54] METHOD FOR PROCESSING A PHOTOGRAPHIC MATERIAL BY SURFACE APPLICATION

[75] Inventors: Christiane M. Feumi Jantou, Chalon sur Saone; Jean-Louis Grinenval, Givry, both of France

[73] Assignee: Eastman Kodak Company, Rochester, N.Y.

[21] Appl. No.: 09/218,893

[22] Filed: Dec. 22, 1998

[30] Foreign Application Priority Data

Dec. 22, 1997 [FR] France ..... 9716594

[51] Int. Cl.[7] ..... G03D 5/06

[52] U.S. Cl. ..... 396/571; 396/578; 396/606

[58] Field of Search ..... 396/571, 576, 396/578, 604, 606, 607, 608, 612, 626, 627, 628, 575, 573, 752, 577

[56] References Cited

U.S. PATENT DOCUMENTS

| | | | |
|---|---|---|---|
| 4,737,810 | 4/1988 | Kobayashi et al. | 396/571 |
| 4,841,320 | 6/1989 | Takekoshi et al. | 396/571 |
| 5,752,121 | 5/1998 | Earle et al. . | |

*Primary Examiner*—Alan A. Mathews
*Attorney, Agent, or Firm*—J. Lanny Tucker

[57] ABSTRACT

A method for processing a photographic material can be carried out by surface application. A device for processing a silver halide photographic material comprises a means for measuring the surface temperature of the material. This device affords more efficient and more reproducible processing.

10 Claims, 3 Drawing Sheets

METHOD FOR PROCESSING A PHOTOGRAPHIC MATERIAL BY SURFACE APPLICATION

FIELD OF THE INVENTION

This invention relates to a new method for processing a photographic material. More particularly, the invention relates to a method for processing a photographic material by surface application.

BACKGROUND OF THE INVENTION

Conventionally, the processing of a black-and-white photographic material comprises a development step, a fixing step, and a washing step. The processing of color photographic materials comprises a color development step, a bleaching step, a fixing step, and a washing step.

Conventionally, the processing steps are carried out in processing tanks. The photographic materials are transported from one tank to the next by means of belts that have a tendency to carry over chemicals from one processing bath to the next one. This bath pollution by carry-over impairs the efficiency of the processing baths. In particular, with polluted baths, the sensitometry of photographic materials becomes uneven.

In conventional processing methods, monitoring of processing solutions is required at all process steps in order to measure the activity of these processing solutions. By this monitoring the processing chemicals can be renewed as they are consumed by the process.

Conventional processing of photographic materials requires the use of large volumes of processing solutions, which later have to be recycled or destroyed. The recycling or destruction of these solutions causes numerous problems, in particular concerning environmental protection. These problems are growing more acute as the standards of chemical effluent disposal are becoming increasingly stringent.

Photographic processing systems exist that use reduced amounts of processing solution. For example, U.S. Pat. No. 5,752,121 (Earle et al) describes a device to coat photographic processing solutions that can-be equipped with means to heat the photographic material. This system allows the volumes of processing solutions needed for the photographic material processing to be substantially reduced.

However, when these methods of surface application of processing solutions are used, variability of sensitometric data is noted.

The object of this invention is to provide a device for the processing of a photographic material by surface application that affords an improved efficiency and reproducibility of sensitometric data.

SUMMARY OF THE INVENTION

According to this invention, a device for processing a photographic material comprising a support having on at least one side thereof a silver halide emulsion layer, comprises: means for supporting the photographic material to be processed, means for heating the photographic material, means for coating a photographic processing solution on the surface of the photographic material furthest from the support, a termperature control unit of the means for heating the photographic material, and a sensor for measuring the temperature of the photographic material surface furthest from the support.

This invention also relates to a method for processing a photographic material noted above, the comprising the following steps: coating a processing solution layer on the surface of the photographic material furthest from the support, measuring the temperature of the photographic material surface furthest from the support, and controlling the photographic material temperature according to the temperature measured at the surface of the photographic material furthest from the support.

DETAILED DESCRIPTION OF THE INVENTION

Unexpectedly, the device and the process of this invention afford a processing of photographic materials with improved efficiency, and a better sensitometric reproducibility.

In the scope of this invention, at least one step of conventional photographic processing is carried out with the device or the process of this invention.

The processing step(s) that can be carried out in the scope of this invention is(are) any conventional photographic processing step, e.g., a development step, a washing step, a fixing step, a bleaching step, or a bleaching-fixing step.

According to the invention, the processing step(s) is(are) carried out by surface application of a processing solution, i.e., the exposed photographic material is not immersed in a tank filled with processing solution, but the surface of the photographic material bearing the photographic emulsion layer(s), i.e., the surface furthest from the support, is coated with a processing solution.

The processing solution application can be achieved by any known method that allows an aqueous solution to be coated evenly on a plane support so as to form a layer. This application can be manual or automated. For example, such a layer can be formed by spraying, soaking, vaporization, or coating.

With the device and process of this invention, photographic materials can be processed in a highly satisfactory and reproducible way with a volume of solution of from 20 to 200 ml/m$^2$, preferably from 20 to 100 ml/m$^2$, and more preferably from 20 to 50 ml/m$^2$.

In a particular embodiment, the process of the invention comprises an additional step that is the elimination of excess processing solution. This additional step can be carried out by means of a doctor blade, a wiper, an absorbing material, etc.

Figures 1A, 1B:
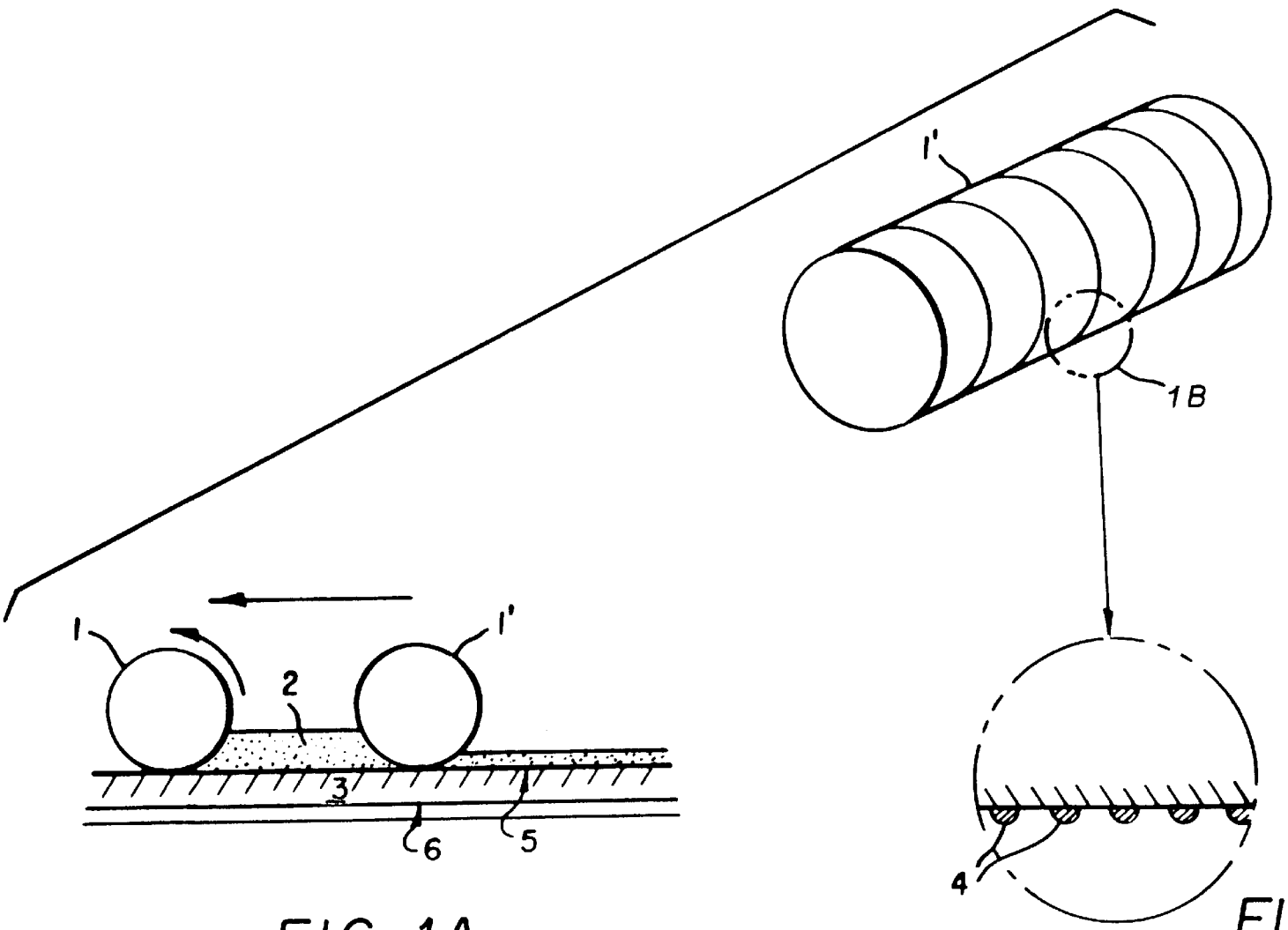
FIGS. 1 and 2 are schematic drawings of devices for processing a photographic material by surface application that are useful in the scope of this invention.

In a particular embodiment, the processing solution is coated using the device illustrated in FIG. 1, which comprises two rollers 1 and 1' linked together and forming a reservoir holding the processing solution to be spread 2, the whole set being laid on the surface of the photographic material 3 to be processed, the material lying on a support equipped with a heater 6. The front roller 1 is covered with flexible rubber, the rear roller 1' has a grooved surface 4 that controls the spreading of the processing solution 5. The device is equipped with means (not illustrated in the figure) to move its two rollers automatically over the photographic material to deposit a thin, even layer of processing solution on the material.

Figure 2:
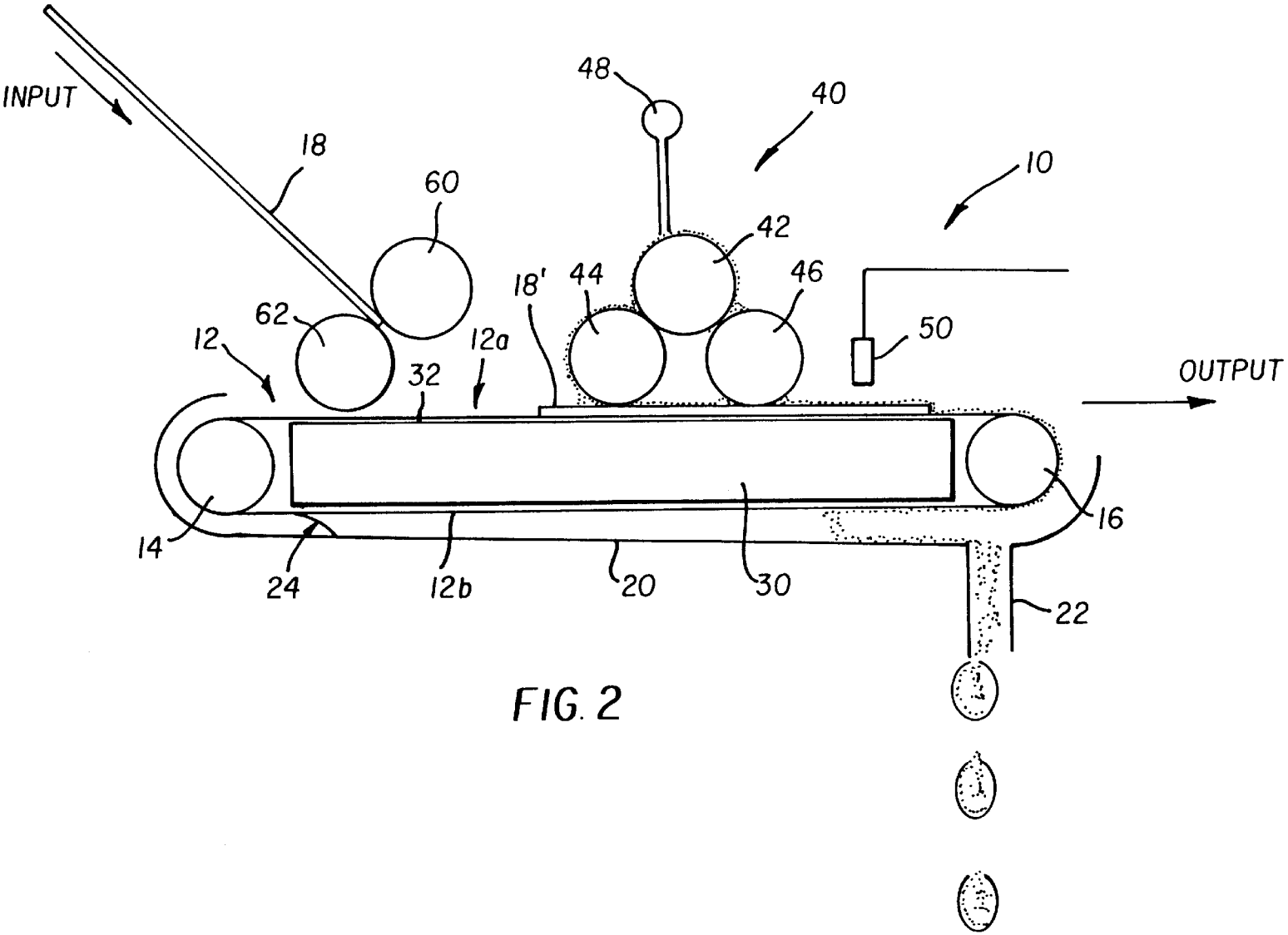
Figure 3:
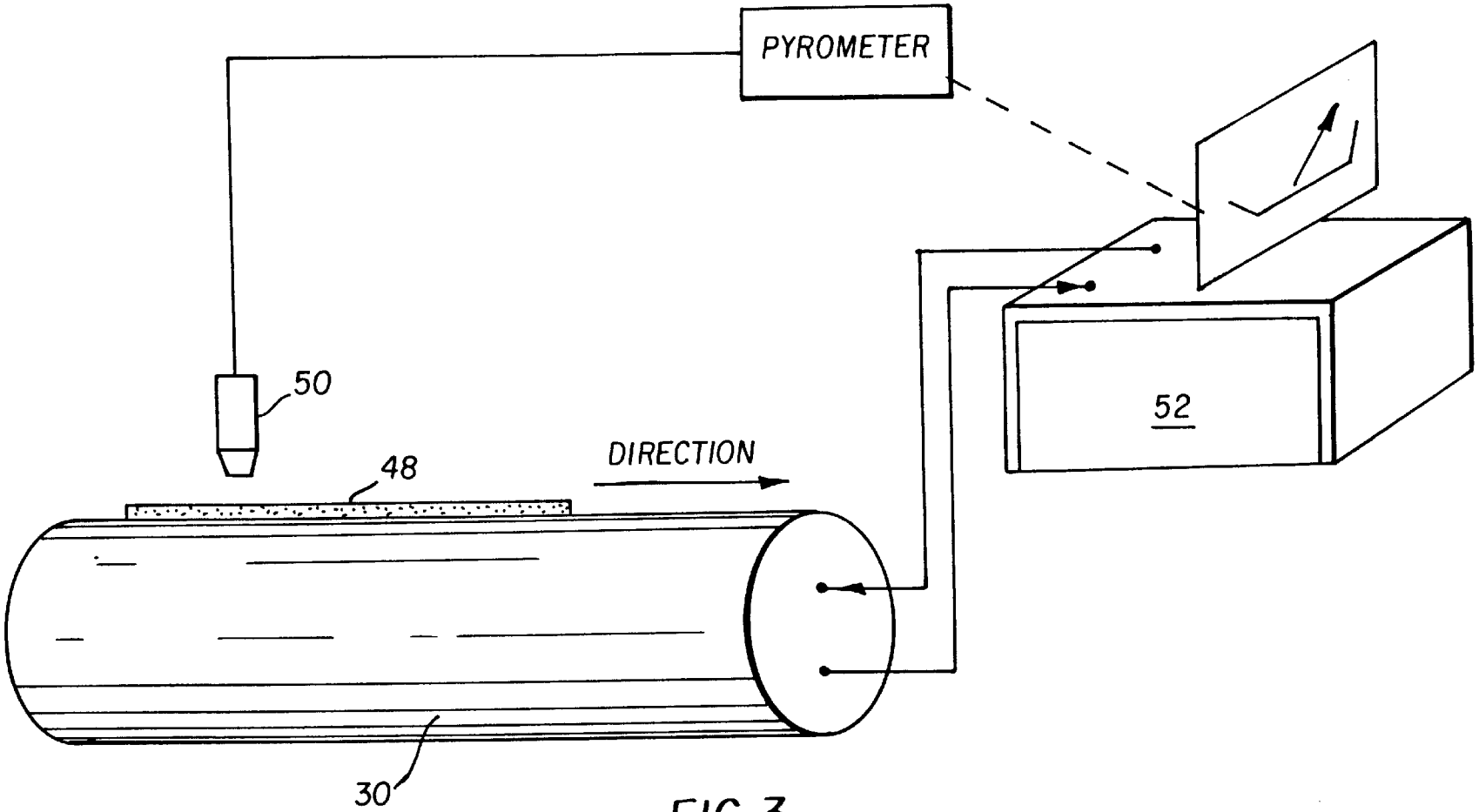
FIG. 3 is a schematic drawing of a device according to this invention.

In another embodiment, the processing solution is applied using device 10 illustrated in FIGS. 2 and 3, which comprises an endless conveyer belt 12 mounted on two spaced rollers 14 and 16, as illustrated. Parts 12*a* and 12*b* of the belt 12 located between the rollers 14 and 16 are in a near-horizontal plane, part 12*a* being the upper part on which is placed the material 18' that is to be —treated. At least one of the rollers 14 and 16 is coupled to a motor (not shown) so that the drive is transmitted to belt 12. Of course, FIG. 2 shows the position of belt 12 at a particular time, and the parts 12*a* and 12*b* comprise different parts of the belt 12 at different times. A temperature sensor 50 is located close to the film but not in contact with the film.

A tray 20 is positioned under and around the conveyer belt 12 to collect any processing solution carried round by it. Tray 20 is fitted with a discharge tube 22 through which the processing solution can be drawn off. A doctor blade 24 is provided in the tray 20 so as to stroke the lower part 12*b* of the belt 12. The doctor blade 24 removes excess processing solution from the surface of the belt 12 as it is carried round by the rollers 14 and 16. The doctor blade 24 is secured inside the tray 20 by any suitable means (not shown).

A heating element 30 is positioned between the rollers 14 and 16. Its top 32 comes into contact with the part 12*a* of the conveyer belt 12. Hot water 52 is supplied to the heating element 30 to obtain the appropriate processing temperature by any suitable arrangement of tubing (not shown). The heat from the heating element 30 is transferred to the material 18' via the top 32 of the heating element 30 and the upper part 12*a* of the belt 12 (which, as described above, changes constantly as the belt 12 is driven by the rollers 14 and 16).

Located above the belt 12 is an applicator device 40. This applicator device comprises three rollers, 42, 44, and 46, mounted so as to rotate, and positioned so as to be above the part 12*a* of the belt 12, the lower rollers 44 and 46 making contact with the part 12*a*. The roller 42 is positioned above rollers 44 and 46 and makes contact with the two rollers 44 and 46. No drive is provided for rollers 42, 44 and 46. The rollers 42, 44 and 46 are rotated by the contact of the lower rollers 44 and 46 with the part 12*a* of the belt 12 and the material 18' as it is carried along by the belt 12.

The applicator device 40 also comprises a metering device 48 designed to deliver predetermined quantities of processing solution onto the upper roller 42, which in turn transfers the processing solution to the lower rollers 44 and 46, and onto the material 18' and the belt 12.

The photographic material 18 to be processed is led to the processing stage 10 by means of a pair of input rollers 60 and 62 that are driven at practically the same speed as that of the conveyer belt 12. The material 18 is retained on the upper part 12*a* of the belt 12 by surface tension, the belt 12 being wetted with the processing solution from the applicator device or by a separate application of water or other suitable liquid (not shown).

As illustrated in FIG. 2, a sheet of photographic material 18 is fed in between a pair of input rollers 60 and 62, as another sheet 18' travels under the applicator device 40. The same arrangement can be used to process a spool of photographic film.

Each roller 42, 44 and 46 is preferably a solid, smooth rubber-surfaced roller. However, the roller surface can be made of any other suitable material. The surface of the rollers can be grooved, or the rollers can be appropriately etched according to the specific application.

In a particular embodiment, the temperature sensor allows the recording of the temperature over at least 80% of the width of the photographic material being processed.

In an embodiment of the invention, the sensor is controlled by the heat supply 52 of the heating element 30.

Temperature sensor useful in this invention is preferably a device that measures the temperature of the photographic material surface on which the processing solution is to be applied (or has been applied), without the sensor coming into contact with the photographic material, because exposed photographic materials thus processed are sensitive to visible light and mechanical stresses. For example, the photographic material processing must not leave any scratches or marks.

In the scope of the invention, infrared sensors have been used to advantage. In an infrared sensor, radiant energy is collected by an optical system and converges onto a detector inside a pyrometer. The detector produces an electrical signal that, after processing, is proportional to the temperature of the source, i.e., the temperature of the film surface. The hotter the energy source, the stronger is the electrical signal.

The distance between the sensor and the film depends on the type of sensor used.

The device and the process of the invention can be used to process any type of photographic material. For example, negative photographic materials, positive photographic materials, black-and-white photographic materials such as radiographic materials, materials for graphics, color photographic materials, and reversal photographic materials can be processed.

Conventionally, photographic materials comprise a support having on at least one side thereof a silver halide emulsion layer. These photographic materials are described in *Research Disclosure*, Sep. 1994, 368, No. 36544 (referred to hereafter as *Research Disclosure*).

The silver halide emulsion is composed of silver halide grains in a hydrophilic binder, e.g., gelatin. Various methods for preparing these emulsions have been described in *Research Disclosure*, section W-C. Gelatin can be replaced in part by other synthetic or naturally-occurring hydrophilic colloids such as albumin, casein, zein, a polyvinyl alcohol, or cellulose derivatives, e.g., carboxymethylcellulose. Such colloids are described in *Research Disclosure*, section II. The silver halide grains can be of various shapes (see *Research Disclosure*, section 1-B).

*Research Disclosure*, section 1-A, describes the silver halide compositions of these grains. The silver halide grains can be composed of chloride, bromide, chlorobromide, bromochloride, chloroiodide, bromoiodide or bromochloroiodide. In a preferred embodiment, the emulsion contains mainly silver chloride.

Silver halide grains can be chemically sensitized as described in *Research Disclosure*, section IV.

Silver halide grains can be spectrally sensitized as described in *Research Disclosure*, section V.

In addition to the above-mentioned compounds, the photographic material can contain other photographically useful compounds, e.g., coating aids, stabilizers, plasticizers, antifogging agents, hardeners, antistatic agents, matting agents, etc. Examples of these compounds are described in *Research Disclosure*, sections VI, VII, VIII, and X.

Supports useful in photography are described in *Research Disclosure*, section XV. These supports are generally polymeric supports such as cellulose polymers, polystyrenes, polyamides, vinyl polymers, polyethylenes, polyesters, and paper or metal supports.

Photographic materials can contain additional layers, e.g., a protective overcoat layer, interlayers, an antihalo layer, an antistatic layer, etc. These different layers and their arrangements are described in *Research Disclosure*, section XI.

The invention is described in more details in the following examples:

EXAMPLE 1

A photographic material was used that comprises a polyethylene terephthalate (ESTAR®) support coated with an underlayer of gelatin (1.8 g/m$^2$) containing a developing agent (tertiobutylhydroquinone (TBHQ), 1.7 g/m$^2$), an auxiliary developing agent (4-methyl-4-hydroxymethylphenidone, 0.1g/m$^2$), a hardener (bisvinylmethylsulfone, 3.5% by weight relative to the total dry gelatin). This underlayer was coated with a silver halide emulsion layer, itself coated with a protective overcoat layer of gelatin (0.8 g/m$^2$).

The silver halide emulsion was composed of cubic grains (edge length of 0.2 microns) of silver chlorobromide (70 mole % chloride) doped with rhodium. The grains were chemically sensitized with sulfur ($2.98\times10^{18}$ atoms of sulfur/mol Ag) and gold ($3.50\times10^{18}$ atoms of gold/mol Ag). The emulsion was spectrally sensitized in the blue region.

The films used in this example were unexposed unused films. To simulate processing, the films with the format described above were first of all dipped in a stop bath (3% acetic acid solution, pH=3.5) for 30 seconds to carry out the fixing step on a wet film.

Fixing of the film was carried out on the wet film by application of a quantity of fixing solution of about 50 ml/m$^2$ with the device in FIG. 1 in which the support is heated by means of a thermostated hot water bath, and the film surface temperature sensor is a PYROREF® D pyrometer, available from Chauvin Arnoux, equipped with an infrared sensor.

The fixing solution layer was left in contact with the surface of the film for a set time refer-red to as 'fixing time', during which the fixing reaction takes place. In this example the fixing time was 30 seconds. The excess fixing solution was removed by means of a smooth roller. The film was then washed in water for 2 min. and then dried. The composition of the fixing solution was as follows:

| Composition of the fixing solution | |
|---|---|
| Ammonium thiosulfate | 142 g |
| Sodium sulfite | 15,28 g |
| Boric acid | 6.07 g |
| Tartaric acid | 1.5 g |
| Aluminum sulfate | 7.04 g |
| Wetting agent OLIN 10 G ® | 3% (vol) |

pH=4.10

Water to obtain 1 liter of solution

The efficiency of the fixing was measured by the ratio of the quantity of silver remaining on the film to the initial quantity of silver contained in the film, the quantities of silver being determined by X-ray fluorescence.

Efficiency of fixing=100×(Q Ag initial−Q Ag remaining/Q Ag initial).

In this example, films of the above format with initial silver coating coverage in the range of from 2.1 to 4.4 g/m$^2$ were fixed by surface application. The fixing temperature indicated in the table below is the temperature measured with the infrared sensor at the surface of the film. This temperature was varied between 22° C. and 37° C. The results are set out in Table 1.

TABLE 1

| Film temperature | Initial silver coating coverage (g/m$^2$) | Fixing efficiency |
|---|---|---|
| 22° C. | 2.1 | 90.9 |
| 37° C. | 2.1 | 90.4 |
| 22° C. | 2.6 | 70.2 |
| 37° C. | 2.6 | 87.1 |
| 22° C. | 3.2 | 47.3 |
| 37° C. | 3.2 | 80.3 |
| 22° C. | 3.8 | 50.9 |
| 37° C. | 3.8 | 68.1 |
| 22° C. | 4.4 | 45.3 |
| 37° C. | 4.4 | 69.1 |

These examples show that when the film surface temperature is monitored with an infrared sensor, increasing this temperature increases the efficiency of the fixing. This increase is greater as the initial silver coating coverage is higher.

EXAMPLE 2

In this example, the fixing was carried out by surface application on a wet film under the conditions described, but without temperature monitoring, i.e., the measured temperature was not the temperature of the film surface, but the temperature of the water circulating in the heating element 30.

This temperature was varied between 25° C. and 35° C.

The initial silver coating coverage of the film used in this example was 2.3 g/m$^2$. The fixing time was 30 seconds.

The results are set out in Table 2 below.

TABLE 2

| Temperature | Fixing efficiency |
|---|---|
| 25° C. | 41.3 |
| 30° C. | 69.2 |
| 35° C. | 55.1 |

These examples show that when the film surface temperature is not monitored, the fixing of the photographic material is irregular. In addition, the fixing efficiency is lower than that obtained in Example 1.

These results show that it is particularly useful to monitor the temperature at the film surface by means that do not interfere with the processing of the photographic material.

EXAMPLE 3

In this example, the same film as in Example 1 was fixed in the same operating conditions with the fixing solution described above, but containing 227.2 g/l of ammonium thiosulfate.

The following results were obtained:

TABLE 3

| Film temperature | Initial silver coating coverage (g/m$^2$) | Fixing efficiency |
|---|---|---|
| 22° C. | 2.1 | 96.6 |
| 37° C. | 2.1 | 98.4 |
| 22° C. | 2.6 | 88.2 |
| 37° C. | 2.6 | 96.2 |
| 22° C. | 3.2 | 84.4 |
| 37° C. | 3.2 | 89.0 |

TABLE 3-continued

| Film temperature | Initial silver coating coverage ($g/m^2$) | Fixing efficiency |
|---|---|---|
| 22° C. | 3.8 | 68.9 |
| 37° C. | 3.8 | 75.6 |
| 22° C. | 4.4 | 66.0 |
| 37° C. | 4.4 | 71.0 |

The invention has been described in detail with particular reference to certain preferred embodiments thereof, but it will be understood that variations and modifications can be effected within the spirit and scope of the invention.

We claim:

1. A device for processing a photographic material comprising a support having on at least one side thereof at least one silver halide emulsion layer, said device comprising:

means for supporting the photographic material to be processed, means for heating said photographic material, means for coating a photographic processing solution on the surface of said photographic material furthest from the support, a temperature control unit of the means for heating said photographic material, and a sensor for measuring the temperature of said photographic material surface furthest from the support.

2. The device of claim 1 further comprising means for conveying said photographic material.

3. The device of claim 1 wherein said means for supporting the photographic material is equipped with said means for heating said photographic material.

4. The device of claim 1 further comprising means for collecting excess processing solutions applied to said photographic material.

5. The device of claim 1 wherein said temperature sensor and said photographic material are not in contact.

6. The device of claim 5 wherein said temperature sensor is an infrared sensor.

7. The device of claim 1 wherein said temperature sensor is controlled by said temperature control unit.

8. A method for processing a photographic material comprising a support having on one side thereof at least one silver halide emulsion layer, said method comprising the following steps:

coating a processing solution layer on the surface of said photographic material furthest from said support, measuring the temperature of said photographic material surface furthest from said support, and controlling said photographic material temperature according to the temperature measured at the surface of said photographic material furthest from said support.

9. The method of claim 8 wherein said silver halide emulsion contains mainly silver chloride.

10. The method of claim 8 wherein the temperature of said photographic material surface furthest from said support is measured by means of an infrared sensor.

* * * * *